United States Patent [19]

Ogawa et al.

[11] Patent Number: 4,477,558

[45] Date of Patent: Oct. 16, 1984

[54] SILVER HALIDE COLOR PHOTOGRAPHIC LIGHT-SENSITIVE MATERIAL

[75] Inventors: Akira Ogawa; Kozo Aoki; Takayoshi Kamio, all of Kanagawa, Japan

[73] Assignee: Fuji Photo Film Co., Ltd., Kanagawa, Japan

[21] Appl. No.: 487,494

[22] Filed: Apr. 21, 1983

[30] Foreign Application Priority Data

Apr. 28, 1982 [JP] Japan ..... 57-72202

[51] Int. Cl.[3] ..... G03C 7/16

[52] U.S. Cl. ..... 430/384; 430/385; 430/393; 430/505; 430/546; 430/552; 430/553

[58] Field of Search ..... 430/552, 553, 384, 385, 430/546, 505, 393

[56] References Cited

U.S. PATENT DOCUMENTS

| | | | |
|---|---|---|---|
| 3,446,622 | 5/1969 | Magagnoli et al. | 430/553 |
| 3,758,308 | 9/1973 | Beavers et al. | 430/552 |
| 4,333,999 | 6/1982 | Lau | 430/384 |

FOREIGN PATENT DOCUMENTS

| | | | |
|---|---|---|---|
| 1011940 | 12/1965 | United Kingdom | 430/552 |

*Primary Examiner*—J. Travis Brown

*Attorney, Agent, or Firm*—Sughrue, Mion, Zinn, Macpeak & Seas

[57] ABSTRACT

A silver halide color photographic light-sensitive material comprising a support having thereon at least one silver halide emulsion layer, the color photographic light-sensitive material containing a cyan dye forming coupler represented by the following general formula (I):

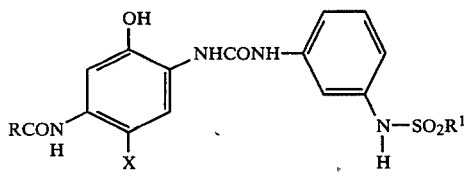

(I)

wherein R represents a substituted or unsubstituted alkyl group, a substituted or unsubstituted aryl group or a heterocyclic group; X represents a hydrogen atom or a group capable of being released upon an oxidative coupling reaction with a developing agent; $R^1$ represents a substituted or unsubstituted alkyl group, a substituted or unsubstituted aryl group or a substituted or unsubstituted heterocyclic group.

The cyan dye forming coupler represented by the general formula (I) has a good solubility in an organic solvent having a high boiling point and a high dye forming rate even in a color developing solution which does not contain benzyl alcohol and provides a cyan color image having a high maximum density and excellent fastness to light. Further, a decrease in optical density of the cyan color image is not substantially observed even when the color photographic light-sensitive material is processed with a bleaching solution which has a weak oxidation power or a bleaching solution which is exhausted.

18 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a novel cyan dye forming coupler.

BACKGROUND OF THE INVENTION

When a silver halide photographic light-sensitive material is subjected to color development after being exposed to light, an oxidized aromatic primary amine developing agent reacts with a dye forming coupler to form a dye image. Generally, in this process, a color reproduction process by a subtractive process is used, wherein dye images of yellow, magenta and cyan which are complement colors of blue, green and red are formed in order to reproduce blue, green and red. As the cyan color image forming coupler, a phenol and a naphthol have often been used. However, a color image obtained from using a phenol or a naphthol has many problems in preservability. For example, a color image obtained from a 2-acylaminophenol cyan coupler as described in U.S. Pat. Nos. 2,367,531 and 2,423,730 has generally inferior fastness to heat, a color image obtained from a 2,5-diacylaminophenol cyan coupler as described in U.S. Pat. Nos. 2,369,929 and 2,772,162 has generally inferior fastness to light, and a 1-hydroxy-2-naphthamide cyan coupler is generally insufficient with respect to its fastness to both heat and light.

A phenol cyan coupler having a ureido group in the 2-position thereof as described in U.S. Pat. Nos. 3,446,622, 3,996,253, 3,758,308 and 3,880,661 and Japanese Patent Application (OPI) No. 65134/81 (the term "OPI" as used herein refers to a "published unexamined Japanese patent application") is said to have good fastness to light as compared with the above-described conventional cyan couplers. However, its fastness is not sufficient for preserving for a long period of time. Further, many of these couplers are not desirable because they easily crystallize when added to the photographic emulsion, due to their low solubility in an organic solvent having a high boiling point.

SUMMARY OF THE INVENTION

An object of the present invention is to provide a silver halide color photographic light-sensitive material using a superior cyan dye forming coupler in which the above-described defects are eliminated and which has good fastness to light and is easily dissolved in an organic solvent having a high boiling point.

Another object of the present invention is to provide a cyan dye forming coupler having a high dye forming rate in a color developing solution and providing a high maximum color density and, particularly, in a color developing solution free from benzyl alcohol.

A further object of the present invention is to provide a cyan dye forming coupler which does not substantially decrease in optical density when a color photographic light-sensitive material containing the coupler is processed with a bleaching solution which has a weak oxidation power or a bleaching solution which is exhausted.

Other objects of the present invention will become apparent from the following detailed description and examples.

These objects of the present invention have been accomplished by a cyan dye forming coupler represented by the general formula (I) described below and a silver halide color photographic light-sensitive material containing a cyan dye forming coupler represented by the following general formula (I):

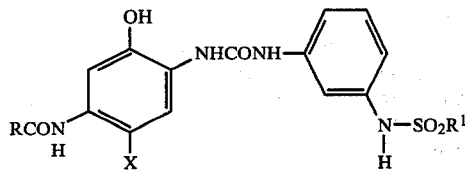

(I)

wherein R represents a substituted or unsubstituted alkyl group, a substituted or unsubstituted aryl group or a substituted or unsubstituted heterocyclic group; X represents a hydrogen atom or a group capable of being released upon an oxidative coupling reaction with a developing agent; and $R^1$ represents a substituted or unsubstituted alkyl group, a substituted or unsubstituted aryl group or a substituted or unsubstituted heterocyclic group.

DETAILED DESCRIPTION OF THE INVENTION

In the following, R, X and $R^1$ in the general formula (I) above are explained in greater detail.

In the general formula (I), R represents a chain or cyclic alkyl group having preferably from 1 to 22 carbon atoms (for example, a methyl group, a butyl group, a pentadecyl group or a cyclohexyl group, etc.), an aryl group (for example, a phenyl group or a naphthyl group, etc.) or a heterocyclic group (for example, a 2-pyridyl group, a 4-pyridyl group, a 2-furyl group, a 2-oxazolyl group or a 2-imidazolyl group, etc.), which may be substituted with one or more substituents selected from an alkyl group, an aryl group, a heterocyclic group, an alkoxy group (for example, a methoxy group, a dodecyloxy group or a 2-methoxyethoxy group, etc.), an aryloxy group (for example, a phenoxy group, a 2,4-di-tert-amylphenoxy group, a 3-tert-butyl-4-hydroxyphenoxy group, a 3-n-pentadecylphenoxy group, a 3-methylsulfonylaminophenoxy group, or a naphthyloxy group, etc.), a carboxy group, a carbonyl group (for example, an acetyl group, a tetradecanoyl group or a benzoyl group, etc.), an ester group (for example, a methoxycarbonyl group, a phenoxycarbonyl group, an acetoxy group, a benzoyloxy group, a butoxysulfonyl group or a toluenesulfonyloxy group, etc.), an amido group (for example, an acetylamino group, an ethylcarbamoyl group, a methanesulfonylamido group or a butylsulfamoyl group, etc.), an imido group (for example, a succinimido group or a hydantoinyl group, etc.), a sulfonyl group (for example, a methanesulfonyl group, etc.), a hydroxy group, a cyano group, a nitro group and a halogen atom.

In the general formula (I), X represents a hydrogen atom or a group capable of being released upon an oxidative coupling reaction with a developing agent. Examples of the coupling-off group represented by X include a halogen atom (for example, a fluorine atom, a chlorine atom or a bromine atom, etc.), an alkoxy group (for example, an ethoxy group, a dodecyloxy group, a methoxyethylcarbamoylmethoxy group, a carboxymethoxy group, a carboxypropoxy group, a butylaminocarbonylmethoxy group, or a methylsulfonylethoxy group, etc.), an aryloxy group (for example, a phenoxy group, a naphthyloxy group or a 4-carboxyphenoxy group, etc.), an acyloxy group (for example, an acetoxy group, a tetradecanoyloxy group or a benzoyloxy group, etc.), a sulfonyloxy group (for example, a methanesulfonyloxy group or a toluenesulfonyloxy group, etc.), an amido group (for example, a dichloroacetylamino group, a heptafluorobutyrylamino group, a methanesulfonylamino group or a toluenesulfonylamino group, etc.), an alkoxycarbonyloxy group (for example, an ethoxycarbonyloxy group or a benzyloxycarbonyloxy group, etc.), an aryloxycarbonyloxy group (for example, a phenoxycarbonyloxy group, etc.), and an imido group (for example, a succinimido group or a hydantoinyl group, etc.).

In the general formula (1), $R^1$ represents a chain or cyclic alkyl group having preferably from 1 to 22 carbon atoms (for example, a methyl group, a butyl group, a dodecyl group or a cyclohexyl group, etc.), an aryl group (for example, a phenyl group or a naphthyl group, etc.) or a heterocyclic group (for example, a 3-pyridyl group, etc.). These groups may be substituted with one or more of the substituents described for R.

In the following, specific examples of the cyan dye forming couplers included in the scope of the present invention are described, but the couplers according to the present invention are not to be construed as being limited thereto.

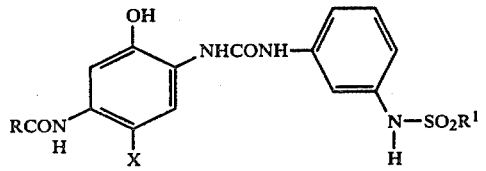

| Coupler No. | R | $R^1$ | X |
|---|---|---|---|
| 1 | 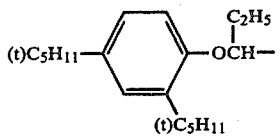 | $CH_3$ | H |
| 2 | " | $CH_3$ | Cl |
| 3 | " | $(n)C_4H_9$ | H |
| 4 | " | $CH_3$ | $-O(CH_2)_3COOH$ |
| 5 | " | $CH_3$ | $-OCH_2CONHC_4H_9$ |
| 6 | 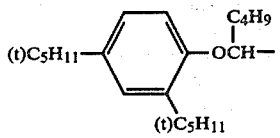 | $CH_3$ | H |
| 7 | " | $C_2H_5$ | Cl |
| 8 | " | $(n)C_8H_{17}$ | H |
| 9 | 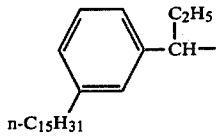 | $CH_3$ | H |
| 10 | " | $(n)C_4H_9$ | H |
| 11 | " | $C_2H_2$ | Cl |
| 12 | 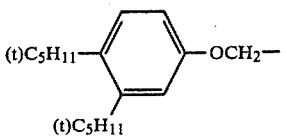 | $CH_3$ | H |
| 13 | $(CH_3)_3C-$ | $(n)C_{12}H_{25}$ | H |
| 14 | $C_3H_7-$ | $(n)C_{16}H_{33}$ | Cl |

-continued

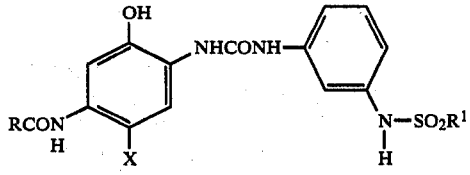

| Coupler No. | R | R1 | X |
|---|---|---|---|
| 15 | 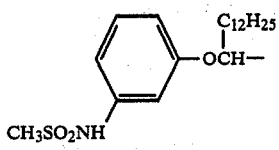 | CH3 | Cl |
| 16 | 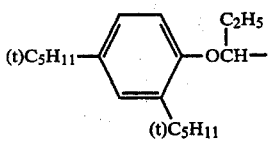 | —CH2CH2OCH3 | H |
| 17 | " | 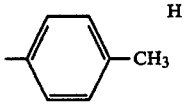 | H |

Typical synthesis examples of the couplers according to the present invention are set forth below.

SYNTHESIS EXAMPLE 1

Synthesis of Coupler (1)

Step (1): Synthesis of 2-(3-methanesulfonamidophenyl)ureido-5-nitrophenol 56 g (0.3 mol) of 3-methanesulfonamidoaniline was dissolved in a mixture of 400 ml of tetrahydrofuran and 26.5 ml of pyridine and to the solution was added dropwise 38 ml (0.3 mol) of phenyl chlorocarbonate under cooling with ice. After stirring for 1 hour, the reaction mixture was poured into 300 ml of water and extracted with ethyl acetate. After washing with water, the solvent was distilled off under a reduced pressure from the extract to obtain 90 g of the light yellow colored oily product. 67 g (0.22 mol) of the product thus obtained was dispersed in 313 ml of xylene together with 34 g (0.22 mol) of 2-amino-5-nitrophenol and 1.8 g of imidazole. The mixture was refluxed by heating for 4 hours and cooled. The crystals thus deposited were collected by filtration to obtain 72.5 g of the desired compound having a melting point of 213° to 215° C.

Step (2): Synthesis of Coupler (1)

37 g (0.1 mol) of the compound obtained in Step (1) above was dispersed in 300 ml of tetrahydrofuran and the mixture was subjected to catalytic reduction under a hydrogen pressure of 40 atms at 70° C. using 3 g of a palladium-carbon catalyst. After removing the catalyst, 26 g (0.2 mol) of quinoline and 34 g (0.1 mol) of 2-(2,4-di-tert-pentylphenoxy)butanoyl chloride were added and the mixture was allowed to stand over night at room temperature. The mixture was poured into diluted hydrochloric acid and extracted with ethyl acetate. After washing with water, the solvent was distilled off under a reduced pressure from the extract and the residue was recrystallized from a solvent mixture of ethyl acetate and acetonitrile to obtain 38.3 g of Coupler (1) having a melting point of 154° to 155° C.

Other couplers, for example, Couplers (3) and (9) could be synthesized in the same manner as described for Coupler (1). The melting points of Couplers (3) and (9) were 137° to 139° C. and 175° to 176° C., respectively.

The cyan dye forming coupler represented by the general formula (I) is incorporated into emulsion layer(s), generally in an amount of from about $2\times10^{-3}$ to $5\times10^{-1}$ mol, preferably $1\times10^{-2}$ to $5\times10^{-1}$ mol, per mol of silver.

The compounds represented by the general formula (I) described above (hereinafter referred to as coupler of the present invention) have an acylamino group in the 5-position and a ureido group in the 2-position of the phenol, and they are characterized by a ureido group having an m-sulfonamidophenyl group defined in the general formula (I) as a substituent. It is believed that many good characteristics are obtained by the introduction of such a group.

More specifically, the couplers of the present invention have excellent solubility in an organic solvent having a high boiling point, good dispersion stability in a photographic emulsion, favorable spectral absorption characteristics, almost no change in the absorption maximum depending on an amount of the organic solvent having a high boiling point used and good transparency. Further, color images obtained from the couplers of the present invention have excellent preservability, namely, excellent fastness to heat and light. The couplers of the present invention are characterized by showing almost no reduction in density when processed with a bleaching solution having a weak oxidation power or a bleaching solution which is exhausted.

The couplers of the present invention are neither disclosed nor suggested in U.S. Pat. Nos. 3,446,622, 3,996,253, 3,758,308 and 3,880,661 and Japanese Patent Application (OPI) No. 65134/81 in which arts concerned with the above-described known cyan couplers are described. Accordingly, the effects shown by the couplers of the present invention are quite surprising.

The photographic emulsion prepared according to the present invention can contain a color image forming coupler other than the coupler of the present invention. Non-diffusible couplers which contain a hydrophobic group referred to as a ballast group in the molecule thereof are preferred as couplers.

Couplers can be 4-equivalent or 2-equivalent to a silver ion. In addition, colored couplers providing a color correction effect, or couplers which release a development inhibitor upon development (so-called DIR couplers) can also be present therein. Also, couplers which provide a colorless product on coupling reaction can be employed.

Conventional open chain ketomethylene type couplers can be employed as yellow-color-forming couplers. Of these couplers, benzoyl acetanilide type and pivaloyl acetanilide type compounds are especially effective. Specific examples of yellow-color-forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77.

Pyrazolone type compounds, indazolone type compounds, cyanoacetyl compounds, etc., can be employed as magenta-color-forming couplers, and particularly preferred couplers are pyrazolone type compounds. Specific examples of magenta-color-forming couplers which can be employed are those described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78.

Phenol type compounds, naphthol type compounds, etc., can be employed as cyan-color-forming couplers. Specific examples of cyan-color-forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77.

Colored couplers which can be employed include those described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, West German Patent Application (OLS) No. 2,418,959.

DIR couplers which can be employed include those described, for example, in U.S. Pat. Nos. 3,227,554, 3,617,291, 3,701,783, 3,790,384 and 3,632,345, West German Patent Application (OLS) Nos. 2,414,006, 2,454,301 and 2,454,329, British Pat. No. 953,454, Japanese Patent Application (OPI) Nos. 69624/77, 122335/74, Japanese Patent Publication No. 16141/76.

In addition to DIR couplers, other compounds which release development inhibitors upon development can also be present in the light-sensitive material. For example, such DIR compounds as are described in U.S. Pat. Nos. 3,297,445 and 3,379,529, West German Patent Application (OLS) No. 2,417,914, Japanese Patent Application (OPI) Nos. 15271/77 and 9116/78, etc., can be employed.

Two or more kinds of the couplers described above can be incorporated in the same layer, or the same coupler compound can also be present in two or more layers.

These couplers are incorporated in the emulsion layers, generally in an amount of from about $2\times10^{-3}$ mol to $5\times10^{-1}$ mol, preferably $1\times10^{-2}$ mol to $5\times10^{-1}$ mol, per mol of silver.

Conventional methods, e.g., the method described in U.S. Pat. No. 2,322,027, can be employed to incorporate the couplers into the silver halide emulsion layers. For example, the couplers can be dissolved in an organic solvent having a high boiling point (preferably 150° C. or more) such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate), citric acid esters (e.g., tributyl acetylcitrate), benzoic acid esters (e.g., octyl benzoate), alkyl amides (e.g., diethyl laurylamide), fatty acid esters (e.g., dibutoxyethyl succinate, dioctyl azelate), etc.; or an organic solvent having a boiling point of from about 30° to 150° C. such as a lower alkyl acetate (e.g., ethyl acetate, butyl acetate, etc.), ethyl propionate, sec-butyl alcohol, methyl isobutyl ketone, $\beta$-ethoxyethyl acetate, methyl Cellosolve acetate, etc. Then, the solution is dispersed in a hydrophilic colloid. The above-described organic solvents having a high boiling point and the above-described organic solvents having a low boiling point may be used as mixtures, if desired.

Furthermore, the dispersing method using a polymeric material as described in Japanese Patent Publication No. 39853/76 and Japanese Patent Application (OPI) No. 59993/76 can also be used.

When couplers having an acid group, such as a carboxylic acid group, a sulfonic acid group, etc., are used, they can be incorporated in a hydrophilic colloid as an alkaline aqueous solution thereof.

The hydrophilic colloid layers of the light-sensitive elements prepared in accordance with the present invention can also contain UV absorbents. For example, benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,707,375 and 3,705,805), butadiene compounds (e.g., those described in U.S. Pat. No. 4,045,229) or benzoxazole compounds (e.g., those described in U.S. Pat. No. 3,700,455) can be employed. Furthermore, the compounds as described in U.S. Pat. No. 3,499,762, Japanese Patent Application (OPI) No. 48535/79 can also be used. UV absorbing couplers (e.g., $\alpha$-naphthol type cyan-color-forming couplers) and UV absorbing polymers can also be employed. These UV absorbents can also be mordanted in a specific layer(s), if desired.

The photographic emulsion used in this invention can be prepared using the methods described in, e.g., P. Glafkides, *Chimie et Physique Photographique,* Paul Montel, Paris (1976), G. F. Duffin, *Photographic Emulsion Chemistry*, The Focal Press, London (1966), V. L. Zelikman, et al., *Making and Coating Photographic Emulsions*, The Focal Press, London (1964), etc. That is, any of the acid method, the neutral method, the ammonia method and other methods can be used. Moreover, a soluble silver salt can be reacted with a soluble halogen salt using any of the single jet method, the double jet method, and a combination thereof.

A method in which grains are formed in the presence of an excess of silver ions (i.e., the so-called reverse mixing method) can also be used. As one of the modes of the double jet method, the method in which the pAg of the liquid phase in which the silver halide is to be produced is kept constant, that is, the so-called controlled double jet method, can be used. This method can provide silver halide emulsions having a regular crystal form and an almost uniform grain size.

Two or more silver halide emulsions which are separately prepared can be mixed and then used, if desired.

In the process of the formation of the silver halide grains or physical ripening, cadmium salts, zinc salts, lead salts, thallium salts, iridium salts or complex salts thereof, rhodium salts or complex salts thereof, iron salts or iron complex salts, and the like can be present.

Gelatin can advantageously be used as the binder or protective colloid for the photographic emulsion used in this invention. However, other hydrophilic colloids can be used as well. For example, proteins such as gelatin derivatives, graft polymers comprising gelatin and other high polymers, albumin, casein, etc.; cellulose derivatives such as hydroxyethyl cellulose, carboxymethyl cellulose, cellulose sulfates, etc.; saccharide derivatives such as sodium alginate, starch derivatives, etc.; and various synthetic hydrophilic high polymers of homo- or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be used as the binder or protective colloid for the photographic emulsion.

Acid-processed gelatin and enzyme-processed gelatin as described in *Bull. Soc. Sci. Photo. Japan, No.* 16, p. 30 (1966) can be used as well as lime-processed gelatin as the gelatin component. In addition, the hydrolyzed products of gelatin and enzyme-decomposed products of gelatin are also suitable. Suitable gelatin derivatives which can be used include those obtained by reacting gelatin with various compounds, such as acid halides, acid anhydrides, isocyanates, bromoacetic acid, alkanesultones, vinylsulfonamides, maleinimides, polyalkylene oxides, epoxy compounds, etc. Specific examples thereof are described in U.S. Pat. Nos. 2,614,928, 3,132,945, 3,186,846, 3,312,553, British Pat. Nos. 861,414, 1,033,189, 1,005,784, Japanese Patent Publication No. 26845/67.

As the above-described gelatin graft polymer, those which are obtained by grafting homo- or copolymers of vinyl monomers such as acrylic acid, methacrylic acid, the ester or amide derivatives thereof, acrylonitrile, styrene, etc., to gelatin can be used. In particular, graft polymers with a polymer having some compatibility with gelatin, such as polymers of acrylic acid, methacrylic acid, acrylamide, methacrylamide, hydroxyalkyl methacrylates, etc., are preferred. Examples thereof are described in U.S. Pat. Nos. 2,763,625, 2,831,767, 2,956,884, etc. Typical synthetic hydrophilic high polymer materials are described in, e.g., West German Patent Application (OLS) No. 2,312,708, U.S. Pat. Nos. 3,620,751, 3,879,205 and Japanese Patent Publication No. 7561/68.

For the purposes of preventing fog or stabilizing the photographic properties during preparation, storage, and/or photographic processing of light-sensitive materials, a variety of compounds can be incorporated into photographic emulsions used according to the present invention. For example, a wide variety of compounds which are known as anti-fogging agents or stabilizers, such as azoles, e.g., benzothiazolium salts, nitrobenzimidazoles, nitroindazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thioketo compounds, such as oxazolinethione; azaindenes, e.g., triazaindenes, tetraazaindenes (especially 4-hydroxy-substituted (1,3,3a,7)-tetraazaindenes), pentaazaindenes, etc.; benzenethiosulfonic acid, benzenesulfinic acid, benzenesulfonic amide, etc.; can be used. For example, the compounds as described in U.S. Pat. Nos. 3,954,474 and 3,982,947, Japanese Patent Publication No. 28660/77 can be used.

For the purposes of increasing sensitivity, increasing contrast, or accelerating development, the photographic emulsion layer(s) of the photographic light-sensitive element according to the present invention can contain other known additives, such as, for example, polyalkylene oxides or derivatives thereof such as ethers, esters, amines, etc., thioether compounds, thiomorpholine compounds, quaternary ammonium compounds, urethane derivatives, urea derivatives, imidazole derivatives, 3-pyrazolidones, etc. For example, such additives as described in U.S. Pat. Nos. 2,400,532, 2,423,549, 2,716,062, 3,617,280, 3,772,021, 3,808,003, British Pat. No. 1,488,991, etc., can be used.

The photographic emulsion of the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

In addition to merocyanine dyes and complex merocyanine dyes, those with nuclei having a ketomethyl structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, and so forth may also be used.

Further useful sensitizing dyes include those described in German Pat. No. 939,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Publication Nos. 14030/69 and 24844/77, and so forth.

These sensitizing dyes can be employed individually, and can also be employed in combination. A combination of sensitizing dyes is often used, particularly for the purpose of supersensitization.

Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic ring group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, and the like, can be present. The combinations described in U.S. Pat. Nos. 3,615,613, 3,615,641, 3,617,295 and 3,635,721 are particularly useful.

The hydrophilic colloid layers of the light-sensitive material prepared according to the present invention can contain water-soluble dyes, as filter dyes, for purposes of preventing certain irradiations or other purposes. Such dyes include oxonol dyes, hemioxonol dyes, styryl dyes, merocyanine dyes, cyanine dyes and azo dyes. Of these dyes, oxonol dyes, hemioxonol dyes and merocyanine dyes are especially useful. Specific examples of such dyes which can be employed are described, for example, in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

The photographic emulsion layers and other hydrophilic colloid layers of the light-sensitive material prepared in accordance with the present invention can contain whitening agents, such as stilbenes, triazines, oxazoles, coumarins, etc. These agents can be water-soluble or can also be employed as a dispersion of water-insoluble whitening agents. Specific examples of fluorescent whitening agents are described in U.S. Pat. Nos. 2,632,701, 3,269,840 and 3,359,102, and British Pat. Nos. 852,075 and 1,319,763.

In the practice of the present invention, known color fading preventing agents as described below can be employed. These fading preventing agents can be used individually or in a combination of two or more thereof. Specific examples of known color fading preventing agents include, for example, hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921; gallic acid derivatives as described in U.S. Pat. Nos. 3,457,079 and 3,069,262; p-alkoxyphenols as described in U.S. Pat. Nos. 2,735,765 and 3,698,909, Japanese Patent Publication Nos. 20977/74 and 6623/77; p-oxyphenol derivatives as described in U.S. Pat. Nos. 3,432,300, 3,573,050, 3,574,627 and 3,764,337, Japanese Patent Application (OPI) Nos. 35633/77, 147434/77 and 152225/77; and bisphenol derivatives as described in U.S. Pat. No. 3,700,455, and so forth.

Light-sensitive elements prepared according to the present invention can also contain, as color fog preventing agents, hydroquinone derivatives, aminophenol derivatives, gallic acid derivatives, ascorbic acid derivatives, or the like. Specific examples of these agents are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, and so forth.

The present invention is also applicable to multilayer multicolor photographic materials containing layers sensitive to at least two different spectral wavelength ranges on a support. A multilayer color photographic material generally possesses at least one red-sensitive silver halide emulsion layer, at least one green-sensitive silver halide emulsion layer, and at least one blue-sensitive silver halide emulsion layer, respectively, on a support. The order of these layers can be varied if desired. Ordinarily, a cyan-forming coupler is present in a red-sensitive emulsion layer, a magenta-forming coupler is present in a green-sensitive emulsion layer, and a yellow-forming coupler is present in a blue-sensitive emulsion layer, respectively. However, if desired, different combinations can be employed.

Known methods can be used for processing the light-sensitive material according to the present invention. Known processing solutions can be used. The processing temperature can be between about 18° C. and about 50° C., in general, but temperatures lower than about 18° C. or higher than about 50° C. may be used, if desired. Either a development processing for forming silver images (black-and-white photographic processing) or a color photographic processing comprising developing processing for forming dye images can be employed, as desired.

The color developer generally comprises an alkaline aqueous solution containing a color developing agent. Suitable color developing agents which can be employed include known primary aromatic amine developing agents, e.g., phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfamidoethylaniline, 4-amino-3-methyl-N-ethyl-N-$\beta$-methoxyethylaniline, etc.).

In addition, developing agents described in L. F. A. Mason, *Photographic Processing Chemistry*, at pages 226 to 229, Focal Press (1966), U.S. Pat. Nos. 2,193,015 and 2,592,364, Japanese Patent Application (OPI) No. 64933/73, etc., can be employed.

The color developers can also contain pH buffering agents, such as sulfites, carbonates, borates and phosphates of alkali metals, developing inhibitors or antifogging agents such as bromides, iodides, organic antifogging agents, etc. In addition, if desired, the color developers can also contain water softeners, preservatives such as hydroxylamine; organic solvents such as benzyl alcohol, diethylene glycol, etc.; developing accelerators such as polyethylene glycol, quaternary ammonium salts, amines; dye-forming couplers; competing couplers; fogging agents such as sodium borohydride; auxiliary developing agents such as 1-phenyl-3-pyrazolidone; viscosity-imparting agents; polycarboxylic acid type chelating agents described in U.S. Pat. No. 4,083,723; anti-oxidizing agents as described in West German Patent Application (OLS) No. 2,622,950; and the like.

The photographic emulsion layers after color development are generally bleach-processed. Bleach processing can be performed at the same time as fixing, or separately therefrom. Suitable bleaching agents which can be employed are compounds of polyvalent metals such as iron (III), cobalt (III), chromium (VI), copper (II), etc., peracids, quinones, nitroso compounds, etc. Specific examples include ferricyanides; bichromates; organic complexes of iron (III) or cobalt (III), for example, complexes of aminopolycarboxylic acids such as ethylenediaminetetraacetic acid, nitrilotriacetic acid, 1,3-diamino-2-propanol tetraacetic acid, etc.; or complexes of organic acids such as citric acid, tartaric acid, malic acid, etc.; persulfates; permanganates; nitrosophenol; etc. Of these compounds, potassium ferricyanide, sodium ethylenediaminetetraacetate iron (III) and ammonium ethylenediaminetetraacetate iron (III) are particularly preferred. Ethylenediaminetetraacetate iron (III) complex is useful both in a bleaching solution and in a mono bath bleach-fixing solution.

Bleaching solutions or bleach-fixing solutions can contain various additives, including bleach accelerating agents as described in U.S. Pat. Nos. 3,042,520 and 3,241,966, Japanese Patent Publication Nos. 8506/70 and 8836/70, thioether compounds as described in Japanese Patent Application (OPI) No. 65732/78, and the like.

The present invention is explained in greater detail with reference to the examples below, but the present invention should not be construed as being limited thereto.

EXAMPLE 1

A solution prepared by heating, at 50° C., a mixture of 30 g of Coupler (1), 30 g of trioctyl phosphate and 50 ml of ethyl acetate was added to 250 ml of an aqueous solution containing 25 g of gelatin and 1.0 g of sodium dodecylbenzenesulfonate with stirring. The mixture was then passed 5 times through a preheated colloid mill, by which the coupler was finely dispersed together with the solvents.

The whole amount of the dispersion thus prepared was added to 1.0 kg of a photographic emulsion containing 54 g of silver iodobromide and 60 g of gelatin and to the mixture, 80 ml of a 2% aqueous solution of 4,6-dichloro-2-hydroxytriazine as a hardener was added. The pH of the mixture was adjusted to 6.0 and coated on a cellulose triacetate film base at a dry thickness of 7.0 microns. This was designated Sample A.

Using the equimolar amount of Couplers (3), (9) and (16) according to the present invention in place of Coupler (1) described above, films were prepared in the same manner as described above for Sample A. These are designated Samples B, C and D, respectively.

For comparison, using the equimolar amount of Comparison Couplers (101), (102) and (103) described below in place of Coupler (1) described above, films were prepared in the same manner as described for Sample A. These are designated Samples E, F and G, respectively.

Comparison Coupler (101)

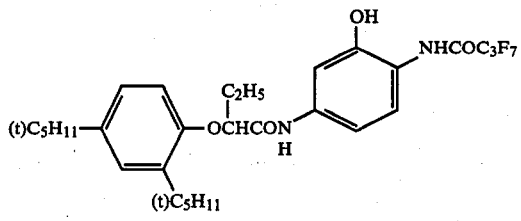

Comparison Coupler (102)

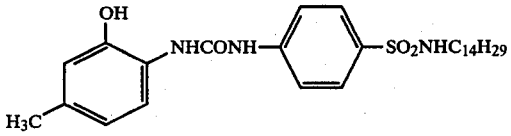

(described in U.S. Pat. No. 3,996,253)

Comparison Coupler (103)

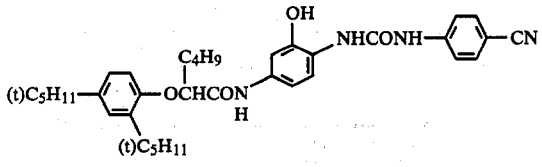

(described in Japanese Patent Application (OPI) No. 65134/81)

These films were exposed to light using a sensitometric continuous wedge and subjected to the following color processing.

| Processing Step | Temperature (°C.) | Time |
|---|---|---|
| 1. Color development | 33 | 3 min 30 sec |
| 2. Bleach-fixing | 33 | 1 min 30 sec |
| 3. Washing with water | 25 to 30 | 2 min 30 sec |

Each of the processing solutions used in the color development processing had the following composition.

| Color Developer Solution | |
|---|---|
| Benzyl Alcohol | 15 ml |
| Diethylene Glycol | 8 ml |
| Ethylenediaminetetraacetic Acid | 5 g |
| Sodium Sulfite | 2 g |
| Anhydrous Potassium Carbonate | 30 g |
| Hydroxylamine Sulfate | 3 g |
| Potassium Bromide | 0.6 g |
| 4-Amino-N—ethyl-N—(β-methanesulfonamidoethyl)-m-toluidine Sesquisulfate | 5 g |

-continued

| | |
|---|---|
| Monohydrate | |
| Water to make | 1 g (pH 10.2) |
| Bleach-Fixing Solution | |
| Ethylenediaminetetraacetic Acid | 2 g |
| Ferric Salt of Ethylenediaminetetra-acetate | 40 g |
| Sodium Sulfite | 5 g |
| Ammonium Thiosulfate | 70 g |
| Water to make | 1 l |

The optical density to red light of each sample thus processed was measured. The results obtained are shown in Table 1 below.

TABLE 1

| Film Sample | Coupler | Gamma | Maximum Density |
|---|---|---|---|
| A | (1) (Present Invention) | 2.80 | 2.61 |
| B | (3) (Present Invention) | 2.82 | 2.72 |
| C | (9) (Present Invention) | 2.91 | 2.76 |
| D | (16) (Present Invention) | 2.97 | 2.80 |
| E | (101) (Comparison) | 2.47 | 2.14 |
| F | (102) (Comparison) | 2.25 | 2.33 |
| G | (103) (Comparison) | 2.14 | 2.28 |

Further, each film thus processed was subjected to examination with respect to fastness. More specifically, the samples were left for 6 days in a dark place at 100° C., the samples were left for 6 weeks in a dark place at 60° C. and 70% RH and the samples were irradiated for 6 days in a xenon test apparatus (100,000 luxes) and a density reduction rate of sample in the area where initial density was 1.0 was measured. The results obtained are shown in Table 2 below.

TABLE 2

| Film Sample | Coupler | 100° C. 6 Days (%) | 60° C. 70% RH 6 Weeks (%) | Light (xenon) 6 Days (%) |
|---|---|---|---|---|
| A | (1) (Present Invention) | 2 | 3 | 4 |
| B | (3) (Present Invention) | 1 | 2 | 6 |
| C | (9) (Present Invention) | 3 | 4 | 5 |
| D | (16) (Present Invention) | 2 | 4 | 6 |
| E | (101) (Comparison) | 16 | 14 | 40 |
| F | (102) (Comparison) | 76 | 11 | 32 |
| G | (103) (Comparison) | 5 | 8 | 9 |

It is apparent from the results shown above that the cyan couplers according to the present invention not only have favorable color forming properties (i.e., high maximum density and high gamma) but also provide cyan color images having excellent fastness.

EXAMPLE 2

Film Samples H to O were prepared in the same manner as described in Example 1 but using the coupler and tricresyl phosphate as an organic solvent having a high boiling point as shown in Table 3 below.

TABLE 3

| Film Sample | Coupler | High Boiling Point Solvent (tricresyl phosphate) |
|---|---|---|
| H | (1) 30 g (Present Invention) | 15 g |
| I | (1) 30 g (Present Invention) | 60 g |
| J | (9) 30 g (Present Invention) | 15 g |
| K | (9) 30 g (Present Invention) | 60 g |
| L | (101) 30 g (Comparison) | 15 g |
| M | (101) 30 g (Comparison) | 60 g |

TABLE 3-continued

| Film Sample | Coupler | High Boiling Point Solvent (tricresyl phosphate) |
|---|---|---|
| N | (103) 30 g (Comparison) | 15 g |
| O | (103) 30 g (Comparison) | 60 g |

These films were stepwise exposed to light using a sensitometric wedge and subjected to the same processing as described in Example 1.

The absorption spectrum of each sample thus processed was measured. The results obtained are shown in Table 4 below.

TABLE 4

| Film Sample | Coupler | Absorption Maximum (μm) |
|---|---|---|
| H | (1) (Present Invention) | 691 |
| I | (1) (Present Invention) | 690 |
| J | (9) (Present Invention) | 676 |
| K | (9) (Present Invention) | 676 |
| L | (101) (Comparison) | 658 |
| M | (101) (Comparison) | 662 |
| N | (103) (Comparison) | 687 |
| O | (103) (Comparison) | 680 |

It is apparent from the results shown above that the cyan couplers according to the present invention have an excellent property that the absorption maximum of the cyan color image formed therefrom does not depend on an amount of the high boiling point organic solvent used.

Furthermore, when the emulsion prepared by emulsifying each of Couplers (1), (3) and (9) together with an organic solvent having a high boiling point and gelatin were allowed to stand in a water bath at 40° C. for 8 hours, deposition of the crystal in the emulsions was not observed. Therefore, it can be seen that these couplers have good dispersibility.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer and a cyan dye forming coupler represented by the following general formula (I):

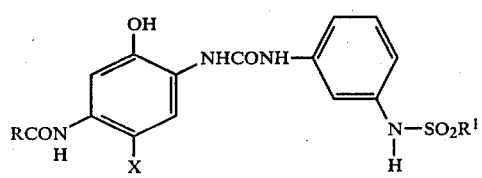

(I)

wherein R represents a substituted or unsubstituted alkyl group, a substituted or unsubstituted aryl group or a substituted or unsubstituted heterocyclic group; X represents a hydrogen atom or a group capable of being released upon an oxidative coupling reaction with a developing agent; and $R^1$ represents a substituted or unsubstituted alkyl group, a substituted or unsubstituted aryl group or a substituted or unsubstituted heterocyclic group.

2. A silver halide color photographic light-sensitive material as claimed in claim 1, wherein the alkyl group represented by R is an alkyl group having from 1 to 22 carbon atoms.

3. A silver halide color photographic light-sensitive material as claimed in claim 1, wherein the substituent for the alkyl group, the aryl group and the heterocyclic group represented by R is selected from an alkyl group, an aryl group, a heterocyclic group, an alkoxy group, an aryloxy group, a carboxy group, a carbonyl group, an ester group, an amido group, an imido group, a sulfonyl group, a hydroxy group, a cyano group, a nitro group and a halogen atom.

4. A silver halide color photographic light-sensitive material as claimed in claim 1, wherein X represents a hydrogen atom.

5. A silver halide color photographic light-sensitive material as claimed in claim 1, wherein X represents a group capable of being released upon an oxidative coupling reaction with a developing agent.

6. A silver halide color photographic light-sensitive material as claimed in claim 1, wherein X represents a halogen atom, an alkoxy group, an aryloxy group, an acyloxy group, a sulfonyloxy group, an amido group, an alkoxycarbonyloxy group, an aryloxycarbonyloxy group, or an imido group.

7. A silver halide color photographic light-sensitive material as claimed in claim 1, wherein the alkyl group represented by $R^1$ is an alkyl group having from 1 to 22 carbon atoms.

8. A silver halide color photographic light-sensitive material as claimed in claim 1, wherein the substituent for the alkyl group, the aryl group or the heterocyclic group represented by $R^1$ is selected from an alkyl group, an aryl group, a heterocyclic group, an alkoxy group, an aryloxy group, a carboxy group, a carbonyl group, an ester group, an amido group, an imido group, a sulfonyl group, a hydroxy group, a cyano group, a nitro group and a halogen atom.

9. A silver halide color photographic light-sensitive material as claimed in claim 1, wherein the cyan dye forming coupler is present in a silver halide emulsion layer.

10. A silver halide color photographic light-sensitive material as claimed in claim 9, wherein the silver halide emulsion layer is a red-sensitive silver halide emulsion layer.

11. A silver halide color photographic light-sensitive material as claimed in claim 9, wherein the cyan dye forming coupler is present in an amount of from $2\times10^{-3}$ mol to $5\times10^{-1}$ mol per mol of silver in the silver halide emulsion layer.

12. A silver halide color photographic light-sensitive material as claimed in claim 10, wherein the photographic material further includes a blue-sensitive silver halide emulsion layer and a green-sensitive silver halide emulsion layer.

13. A silver halide color photographic light-sensitive material as claimed in claim 12, wherein the blue-sensitive silver halide emulsion layer contains a yellow color forming coupler and the green-sensitive silver halide emulsion layer contains a magenta color forming coupler.

14. A silver halide color photographic light-sensitive material as claimed in claim 9, wherein the cyan dye forming coupler is dispersed together with an organic solvent having a high boiling point in a hydrophilic colloid of the silver halide emulsion layer.

15. A method of forming a color image comprising developing an imagewise exposed silver halide color photographic light-sensitive material comprising a support having thereon a silver halide emulsion layer and a cyan dye forming coupler represented by the following general formula (I):

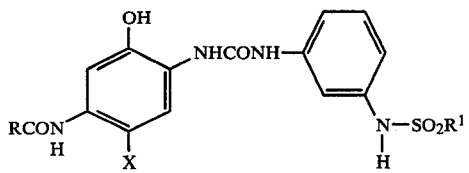

(I)

wherein R represents a substituted or unsubstituted alkyl group, a substituted or unsubstituted aryl group or a substituted or unsubstituted heterocyclic group; X represents a hydrogen atom or a group capable of being released upon an oxidative coupling reaction with a developing agent; and $R^1$ represents a substituted or unsubstituted alkyl group, a substituted or unsubstituted aryl group or a substituted or unsubstituted heterocyclic group; with an alkaline aqueous developing solution containing a primary aromatic amine developing agent.

16. A method of forming a color image as claimed in claim 15, wherein the photographic material, after development, is subjected to processing in a bleach-fixing solution.

17. A method of forming a color image as claimed in claim 16, wherein the bleach-fixing solution contains an ethylenediaminetetraacetate iron (III) complex.

18. A method of forming a color image as claimed in claim 15, wherein the alkaline aqueous developing solution is free from benzyl alcohol.

* * * * *